US005563795A

United States Patent [19]

Futamura et al.

[11] Patent Number: 5,563,795

[45] Date of Patent: Oct. 8, 1996

[54] EMBROIDERY STITCH DATA PRODUCING APPARATUS AND METHOD

[75] Inventors: Masao Futamura; Yukiyoshi Muto; Masahiro Mizuno, all of Nagoya, Japan

[73] Assignee: Brother Kogyo Kabushiki Kaisha, Nagoya, Japan

[21] Appl. No.: 417,790

[22] Filed: Apr. 6, 1995

[30] Foreign Application Priority Data

Jul. 28, 1994 [JP] Japan ..... 6-176511

[51] Int. Cl.[6] ..... G06F 19/00; D05B 21/00

[52] U.S. Cl. ..... 364/470.09; 112/102.5; 112/470.06; 112/475.19

[58] Field of Search ..... 364/470, 191–193, 364/188, 189; 112/80.23, 470.04, 470.06, 475.18, 475.19, 453–458; 382/111

[56] References Cited

U.S. PATENT DOCUMENTS 5,181,176 1/1993 Hayakawa ..... 364/470
5,189,622 2/1993 Hayakawa et al. ..... 364/470
5,191,536 3/1993 Komuro et al. ..... 364/470
5,227,976 7/1993 Hayakawa et al. ..... 364/470
5,299,514 4/1994 Hayakawa et al. ..... 112/102.5

*Primary Examiner*—Joseph Ruggiero
*Attorney, Agent, or Firm*—Oliff & Berridge

[57] ABSTRACT

An original picture of a pattern is scanned with an image scanner to obtain bitmap image data. A border line defining the original picture is extracted. A closed region enclosed by the border line is subjected to a linearizing process. Shape-defining line data is produced for the closed region and stitch data for entirely covering the closed region with zigzag stitches when the closed region can completely be linearized by a number of sequential pixel deleting cycles not greater than a given number. Border line data is produced and stitch data for entirely covering the closed region with satin stitches is automatically produced when the closed region could not be completely linearized by the number of sequential pixel deleting cycles within the given number. Thus, stitch data for satisfactorily embroidering a pattern consisting of a plurality of partial patterns respectively having different widths can be readily and automatically produced from the original picture of the pattern.

15 Claims, 10 Drawing Sheets

Fig.12

| | | | | | | | | | | | | | | | |
|---|---|---|---|---|---|---|---|---|---|---|---|---|---|---|---|
| | | | | | | | | | | | | | | | |
| | | | | | | | | | | | | | | | |
| | | | | | | | | | | | | | | | |
| | | | | | | | | | | | | | | | |
| | | | | | | | | | | | | | | | |
| | | | | | | | | | | | | | | | |
| | | | | | | | | | | | | | | | |
| | | | | | | | | 1 | 1 | 1 | | | | | 1 |
| | | | | | | 1 | 2 | 2 | 2 | 1 | 1 | | | | 1 |
| | | | | | 1 | 2 | 3 | 3 | 3 | 2 | 2 | 1 | | 1 | 2 |
| | | | | 1 | 2 | 3 | 4 | 4 | 4 | 3 | 2 | 1 | | 1 | 2 |
| | | | | 1 | 2 | 3 | 4 | 5 | 5 | 4 | 3 | 2 | 1 | 2 | 3 |
| | | | | 1 | 2 | 3 | 4 | 6 | 6 | 5 | 4 | 3 | 2 | 3 | 4 |
| | | | 1 | 2 | 3 | 4 | 5 | 6 | 7 | 6 | 5 | 4 | 3 | 4 | 5 |
| | | 1 | 2 | 3 | 4 | 5 | 6 | 7 | 8 | 7 | 6 | 5 | 4 | 5 | 6 |
| | | 1 | 2 | 3 | 4 | 5 | 6 | 7 | 7 | 7 | 7 | 6 | 5 | 6 | 7 |
| | | 1 | 2 | 3 | 4 | 5 | 6 | 6 | 6 | 6 | 6 | 6 | 6 | 6 | 6 |
| | | | 1 | 2 | 3 | 4 | 5 | 5 | 5 | 5 | 5 | 5 | 5 | 5 | 5 |
| | | | 1 | 2 | 3 | 3 | 4 | 4 | 4 | 4 | 4 | 4 | 4 | 4 | 4 |
| | | | 1 | 2 | 2 | 2 | 3 | 3 | 3 | 3 | 3 | 3 | 3 | 3 | 3 |
| | | | | 1 | 1 | 1 | 2 | 2 | 2 | 2 | 2 | 2 | 2 | 2 | 2 |
| | | | | | | | 1 | 1 | 1 | 1 | 1 | 1 | 1 | 1 | 1 |
| | | | | | | | | | | | | | | | |
| | | | | | | | | | | | | | | | |
| | | | | | | | | | | | | | | | |
| | | | | | | | | | 1 | 1 | | | | | |
| | | | | | | | | | 1 | 1 | | | | | |
| | | | | | | | | 1 | 1 | | | | | | |
| | | | | | | | | 1 | 1 | | | | | | |
| | | | | | | | 1 | 1 | | | | | | | |
| | | | | | | | 1 | 1 | | | | | | | |
| | | | | | | 1 | 1 | | | | | | | | 1 |
| | | | | | | 1 | 1 | | | | | | | | 1 |
| | | | | | 1 | 1 | | | | | | | | 1 | 1 |
| | | | | | 1 | 1 | | | | | | | | 1 | 1 |
| | | | | 1 | 1 | | | | | | | | 1 | 1 | |
| | | | | | | | | | | | | | | | |
| | | | | | | | | | | | | | | | |
| | | | | | | | | | | | | | | | |
| | | | | | | | | | | | | | | | |

EMBROIDERY STITCH DATA PRODUCING APPARATUS AND METHOD

BACKGROUND OF THE INVENTION

1. Field of the Invention

This invention relates to a stitch data producing apparatus for producing stitch data for controlling the operation of an embroidery sewing machine.

2. Description of the Related Art

A conventional embroidery sewing machine that automatically embroiders a pattern onto a workpiece is controlled according to stitch data specifying a stitching point for each stitching cycle. A stitch data producing apparatus for producing the stitch data controlling the embroidery sewing machine comprises a main unit including a microcomputer, and an image reading device, generally an image scanner, which is connected to the main unit. The main unit functions as an image processing apparatus.

The stitch data producing apparatus produces stitch data by processing image data obtained by scanning an original picture of an embroidery pattern with the image scanner or the like. Since the image provided by the image scanner is a bitmap image., shape defining data defining the shape of each pattern represented by the image data needs to be extracted from the bitmap image so the shape of the pattern represented by the image data can be recognized and for advanced graphic processing, including transforming, dividing, combining, enlarging and reducing one or more embroidery patterns.

Generally, the shape representing data of a pattern having some area is outline data or border line data, i.e., data representing a curved and/or polygonal shape representing the border line of the pattern. A conventional method of obtaining such shape defining data, i.e., border line data, requires an operator to manually trace the border line of a pattern displayed on the screen of a display with a pointing device, such as a mouse. Another method automatically extracts the border line by processing the bitmap image by a border line tracing process. Then, stitch data is produced based on the border line data to fill the space enclosed by the border line. The produced stitch data can specify, for example, filling the enclosed area with satin stitches.

When the pattern is a character or a symbol defined principally by lines, some methods describe the pattern by data representing the lines defining the pattern, i.e., short-vector data. Such data, i.e., shape defining line data, is obtained by tracing the middle line between the lines defining a pattern displayed on the screen of a display with a mouse or the like, or by subjecting the bitmap image to a linearizing process. Stitch data for forming stitches, such as zigzag stitches or running stitches, suitable for forming a line pattern, is produced on the basis of such shape defining line data.

Generally, in such an image processing apparatus or such a stitch data producing apparatus, all sorts of patterns, including pictures, characters and such, are provided. For example, a pattern of a rainfall symbol, as shown in FIG. 4, includes a partial pattern A1 representing a rain cloud and having an area, and partial patterns A2 to A4, which are line patterns and represent rainfall.

The operator needs to give appropriate instructions according to the shapes of the patterns when extracting the shape representing data by a manual scanning operation to produce stitch data by the aforesaid stitch data producing apparatus (image processing apparatus). Such a manual scanning operation requires skill and, when the patterns have complicated shapes, much time. If border line data or shape defining line data is extracted automatically according to a predetermined algorithm, the troublesome operator's work is unnecessary. However, shape representing data satisfactorily representing the type and the shape of a pattern cannot necessarily be obtained unless a border line tracing process or a linearizing process is properly selected according to the type and the shape of the pattern and, in some cases, appropriate stitch data cannot be produced.

When line patterns, such as the partial patterns A2 to A4 representing threads of rain shown in FIG. 4, are represented by border line data, stitch data that fills up the space enclosed by the border line with satin stitches is produced on the basis of the border line data and, consequently, an embroidered pattern of an inferior quality is formed. On the other hand, when the partial pattern A1 representing a rain cloud is represented by shape defining line data, the shape of the pattern is deformed significantly and data correctly representing the shape of the pattern cannot be extracted. Accordingly, either the process using the shape defining line data or the process using the border line data must be selectively used according to the shape of a pattern.

SUMMARY OF THE INVENTION

This invention provides a stitch data producing apparatus for automatically extracting data representing the shape of a pattern from bitmap image, and for providing appropriate data representing the shape of the pattern.

This invention further provides a stitch producing apparatus for automatically producing stitch data based on the data obtained by scanning an original picture of a pattern and for producing appropriate stitch data according to the shape of the pattern.

This invention also provides a stitch data producing apparatus comprising input means for inputting a bitmap image of an original picture of a pattern; determining means for determining an embroidery area from the bitmap image, outline extracting means for obtaining outline data or border line data representing an outline or a border line of an embroidery area by a border line tracing process; reference line extracting means for obtaining reference line data representing a shape of an embroidery area by a linearizing process; and determining means for determining which one of the outline data and the reference line data appropriately represents the shape of the pattern based on a shape of the embroidery area.

This stitch data producing apparatus selectively uses either the outline data or the reference line data to represent the pattern according to the shape of the pattern, so that suitable stitch data for embroidering the pattern can be produced.

Further, the appropriate method for extracting the shape of the embroidery area is determined by a simple process and therefore, high quality embroidering is obtained.

BRIEF DESCRIPTION OF THE DRAWINGS

The preferred embodiments of this invention will be described in detail with reference to the accompanying drawings, wherein:

FIG. 12 is a diagram showing the distance values of pixels determined by distance conversion.

DETAILED DESCRIPTION OF THE PREFERRED EMBODIMENTS

Figure 3:
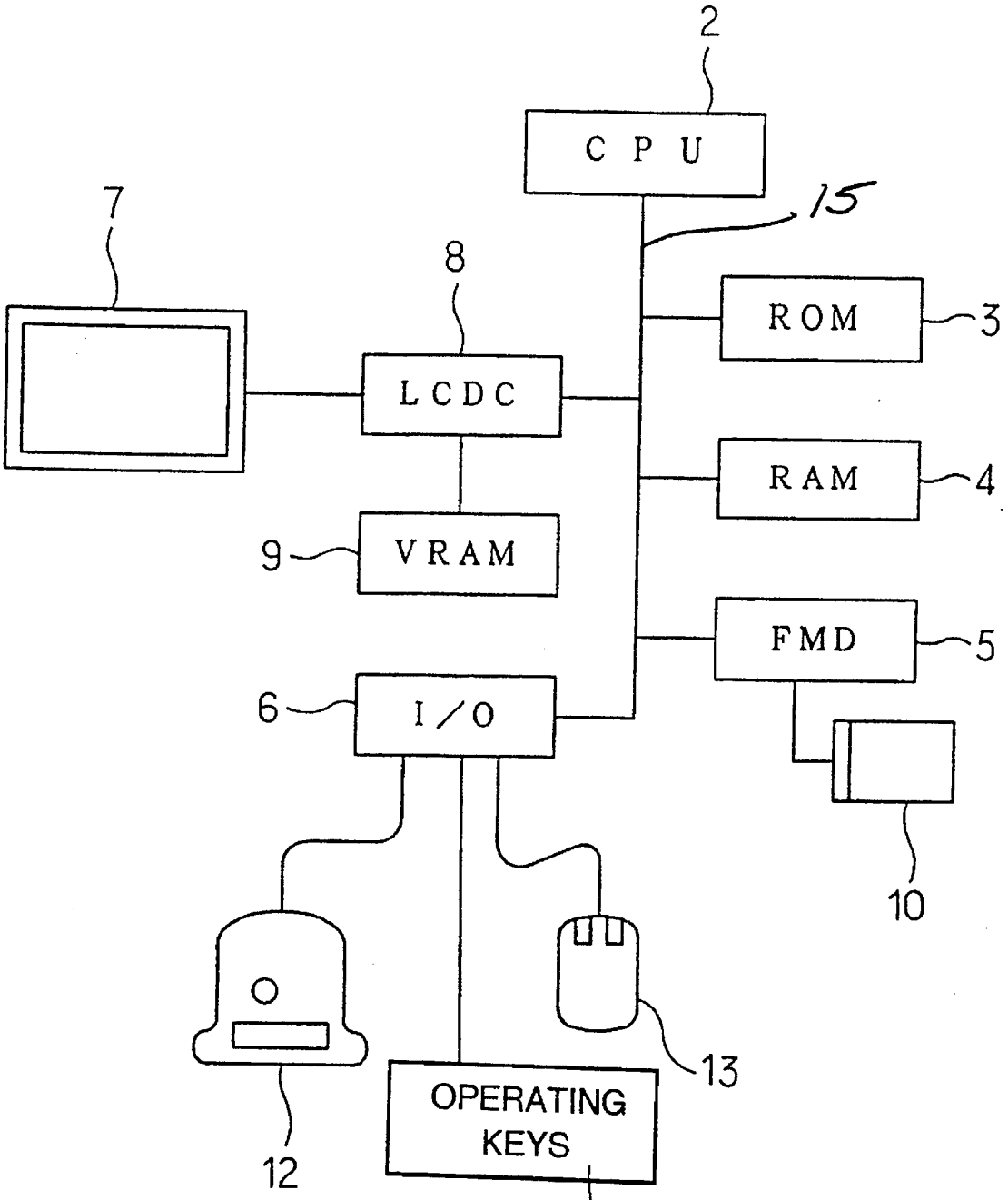
FIG. 3 is a block diagram showing the control system of the stitch data producing apparatus of FIG. 2.
Figure 4:
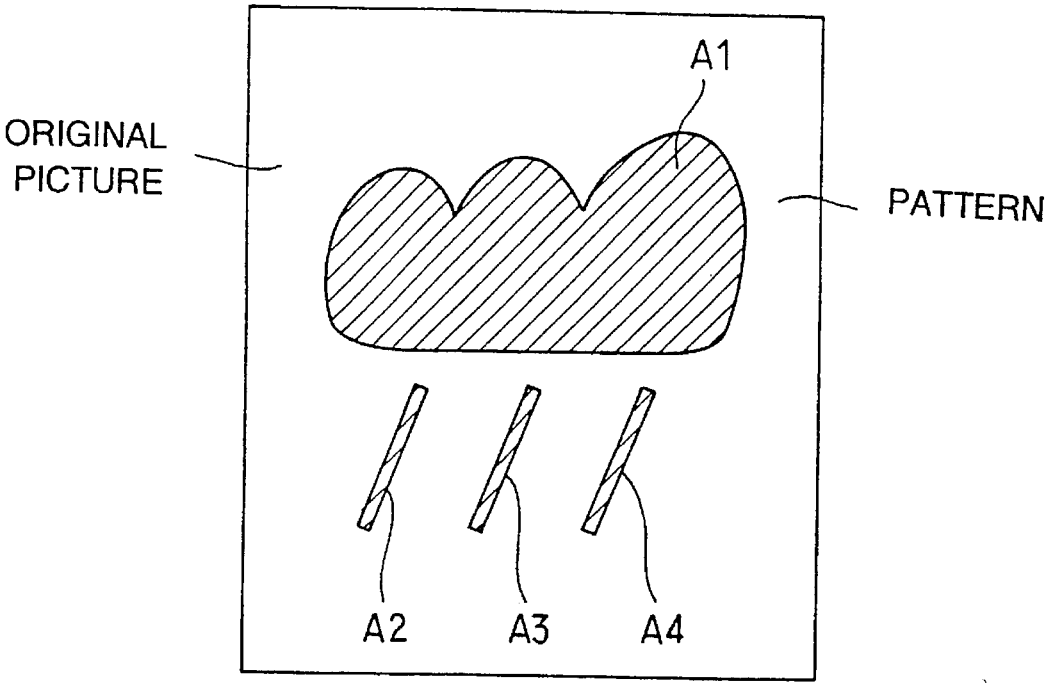
FIG. 4 illustrates an original picture of a pattern.

A first preferred embodiment of a stitch data producing apparatus according to this invention, for producing stitch data for controlling a household embroidery sewing machine, will be described referring to FIGS. 1 to 10 to produce shape representing data representing an exemplary pattern A of an original exemplary picture B, as shown in FIG. 4, and stitch data for stitching the pattern A. The original picture B is a rainfall symbol which is used on a meteorological map in a weather forecast program. As shown in FIG. 4, the pattern A represented by the original picture B has four partial patterns A1 to A4, including one partial pattern A1 representing a rain cloud, and three partial patterns A2 to A4 representing rainfall.

Figure 13:
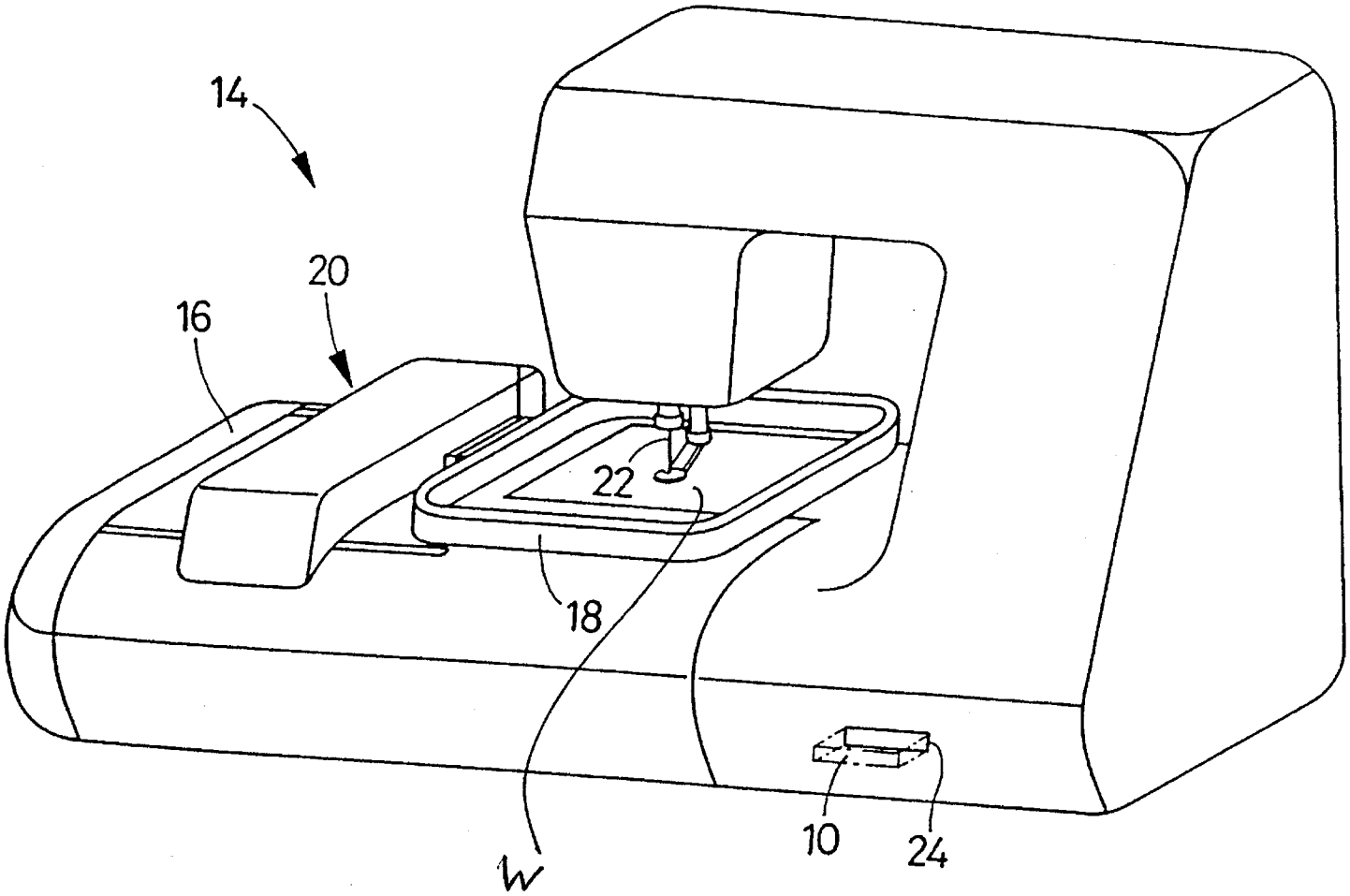
FIG. 13 is a perspective view of an embroidery machine.

A household embroidery sewing machine 14 is shown in FIG. 13. The embroidery machine 14 embroiders the pattern A on the workpiece W held on an embroidery frame 18 by the cooperative stitching operation of a needle 22 and a hook mechanism (not shown) while the embroidery frame 18 is moved on a bed 16 by a horizontal moving mechanism 20 to given positions represented by coordinates on an orthogonal coordinate system specific to the embroidery machine 14.

During the stitching operation, a controller including, for example, a microcomputer, automatically controls the horizontal moving mechanism 20 and the needle 22 according to stitch data input to the controller. The stitch data specifies movement distances along the x-axis and the y-axis and a stitch point for each stitching cycle. The embroidery machine 14 also includes a data read unit 24 for reading the stitch data from an external flash memory 10, such as a card memory, which is loaded into the data read unit 24. A stitch data producing apparatus 1 produces the stitch data input to the data read unit 24.

Figure 2:
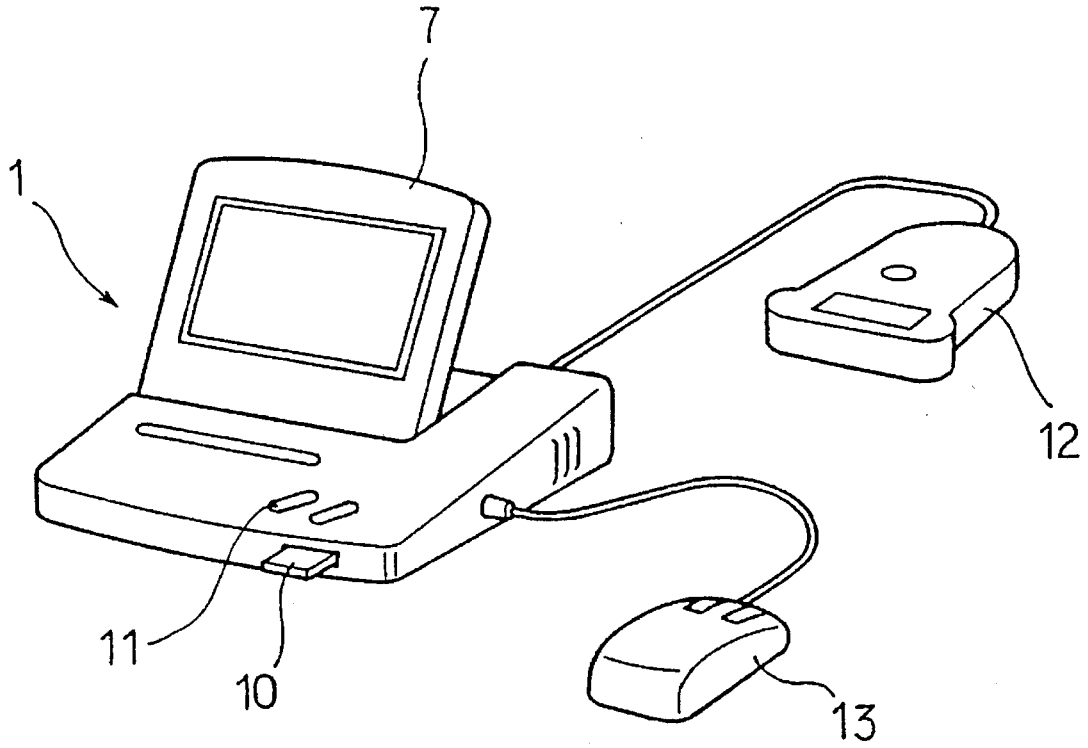
FIG. 2 is a perspective view of the stitch data producing apparatus of the first preferred embodiment.

The stitch data producing apparatus 1 embodying this invention is shown in FIGS. 2 and 3. As shown in FIG. 3, the stitch data producing apparatus 1 includes a microcomputer comprising a CPU 2, a ROM 3, a RAM 4, a flash memory device (FMD) 5, an input/output (I/O) interface 6, and a bus 15 interconnecting these components.

A liquid crystal display (LCD) 7 is installed on the upper wall of the stitch data producing apparatus 1 and includes a screen 7A to display, for example, the pattern A. The liquid crystal display 7 is controlled by a liquid crystal display controller (LCDC) 8. A display data storage device (VRAM) 9 is connected to the liquid crystal display controller 8. The flash memory 10 is detachably loaded into the flash memory device 5. The stitch data producing apparatus 1 is provided with operating keys 11. The operating keys 11 are connected to the CPU 2 through the I/O interface 6.

An image scanner 12, for scanning the original picture B of the pattern A to obtain a bitmap image representing the pattern A, is connected through the I/O interface 6 to the stitch data producing apparatus 1. The image scanner 12 is, for example, a hand-operated binary scanner that scans a monochromatic picture. The operator holds the upper part of the image scanner 12, places the read head of the image scanner 12 against the original picture B and moves the image scanner 12 in one direction pushing the read button to trace the original picture B with the image scanner 12. Then, the image scanner 12 outputs bitmap image data in a raster mode. The bitmap image data output by the image scanner 12 indicates each pixel by a binary density value of "0" or "1", and is stored in the RAM 4. A mouse 13 is connected to the stitch data producing apparatus 1 to set conditions. A keyboard may be used in addition to or instead of the mouse 13.

The stitch data producing apparatus 1 processes the bitmap image of the pattern A output by the image scanner 12 to automatically extract shape representing data representing the shape of a concatenated component pattern, or each one of a plurality of connected component patterns, i.e., the partial patterns A1 to A4. Stitch data for forming the pattern A, comprising the partial patterns A1 to A4, is automatically produced based on the extracted shape representing data. Thus, the stitch data producing apparatus 1 functions both as an image processing apparatus and as the stitch data producing means.

When extracting the shape representing data representing the shape of each of the concatenated component patterns, i.e., the partial patterns A1 to A4, the bitmap image of each of the partial patterns A1 to A4 is subjected to a border line tracing process to obtain border line data. The border line tracing process extracts a chain of pixels forming the border line of the concatenated component pattern. The chain of pixels forming the border line of the concatenated component pattern, i.e., each of the partial patterns A1 to A4, is then subjected to a linearizing process to obtain shape defining line data by extracting the chain of pixels corresponding the middle of the concatenated component pattern.

A decision is made, based on the number of sequential pixel deleting cycles executed during the linearizing process, whether the border line data or the shape defining line data is suitable as the shape representing data for representing each concatenated component pattern or each partial pattern. Then, either the border line data or the shape defining line data is selected as the shape representing data. Thus, the stitch data producing apparatus 1 functions as a border line extracting means, the shape defining line extracting means, and as the data selecting means.

Furthermore, when producing the stitch data for stitching each of the concatenated component patterns, i.e., the partial patterns A1 to A4, the stitch data producing apparatus 1 produces stitch data to entirely cover the space enclosed by the border line with stitches, when the border line data is selected as the shape representing data representing the shape of the concatenated component pattern. The stitch data producing apparatus 1 also produces stitch data for forming zigzag stitches along the shape defining line of each concatenated component pattern when the shape defining line data is selected as the shape representing data.

When producing stitch data for forming the pattern A having the partial patterns A1 to A4, i.e., the rainfall symbol, the original picture B of the pattern A is drawn in black on a white sheet so that the original picture B can be read by the image scanner 12.

Figure 1:
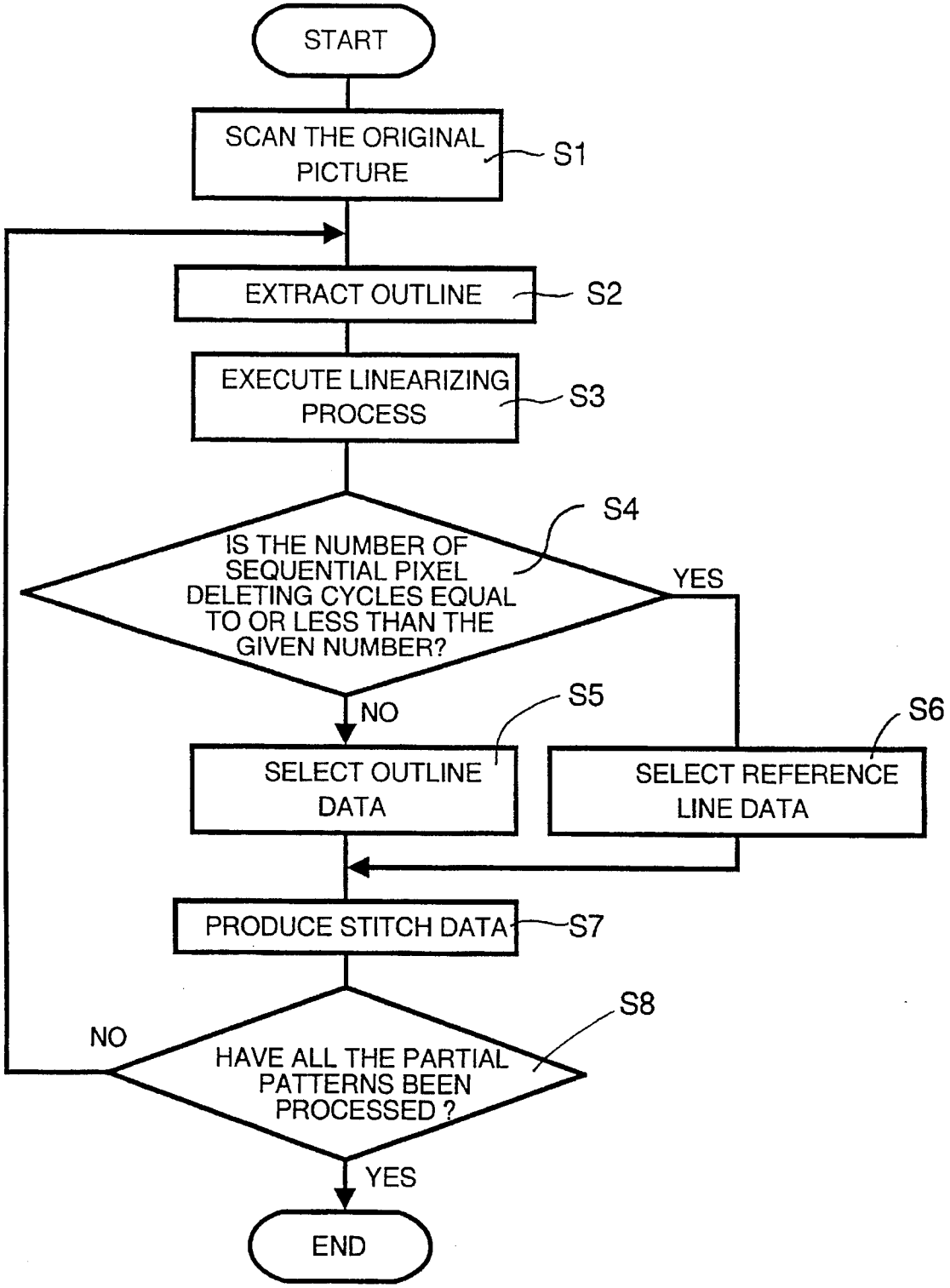
FIG. 1 is a flow chart of a stitch data producing procedure carried out by a first preferred embodiment of a stitch data producing apparatus.
Figure 5:
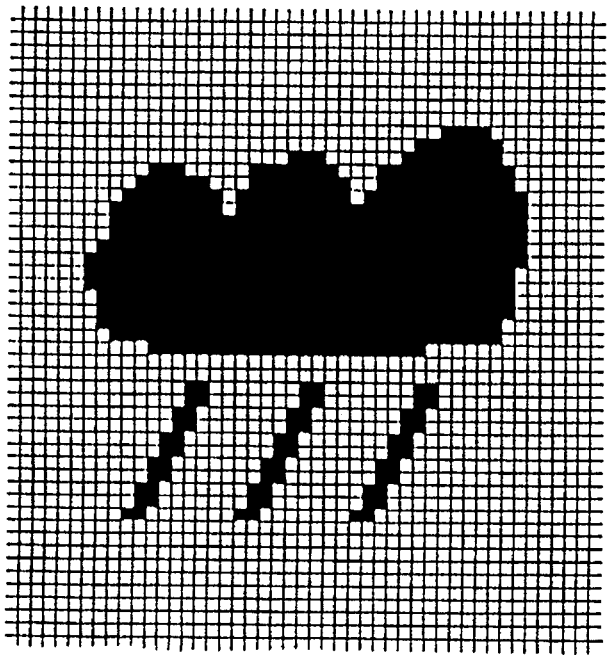
FIG. 5 illustrates a typical bitmap image.

The main switch of the stitch data producing apparatus 1 is turned on to start a stitch data producing program. Then, a stitch data producing procedure outlined in the flowchart shown in FIG. 1 is executed. In step S1, the original picture B is scanned with the image scanner 12. The bitmap image data thus output by the image scanner 12 is stored as a raster bitmap image in the RAM 4. In the raster bitmap image, each bit corresponds to one pixel, and value of each bit is "0" when the corresponding pixel is white, or "1" when the corresponding pixel is black. FIG. 5 shows the bitmap image stored in the RAM 4. Each section of the bitmap image shown in FIG. 5 corresponds to one pixel. Each section is void when the corresponding bit is in the 0 state and is black when the corresponding bit is in the 1 state. The following steps are executed for each of the concatenated component patterns, i.e., the partial patterns A1 to A4, to sequentially produce the corresponding sets of stitch data for the partial patterns A1 to A4.

Figure 6:
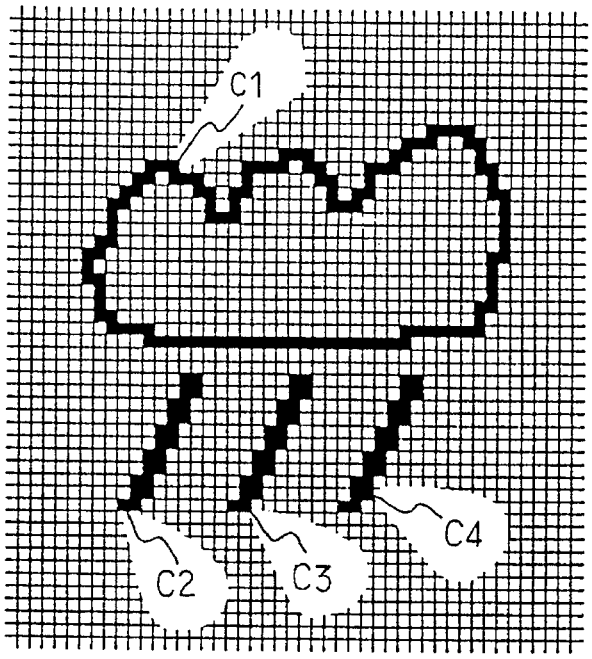
FIG. 6 illustrates a pixel chain defining the border line of a pattern.

In step S2, a chain of pixels forming the border line of each of the groups of connected black pixels, respectively corresponding to the partial patterns A1 to A4, is extracted by using a well-known border line tracing method. In the known border line tracing method, either a 4-bit concatenation or an 8-bit concatenation is used as a criterion for deciding a concatenation, to obtain a set of border line data. Then, the sets of border line data are stored in the RAM 4. The pixel chains C1 to C4, which represent the border lines of the partial patterns A1 to A4, and which were obtained by using a 4-bit concatenation as a criterion, are shown in FIG. 6.

Figure 7:
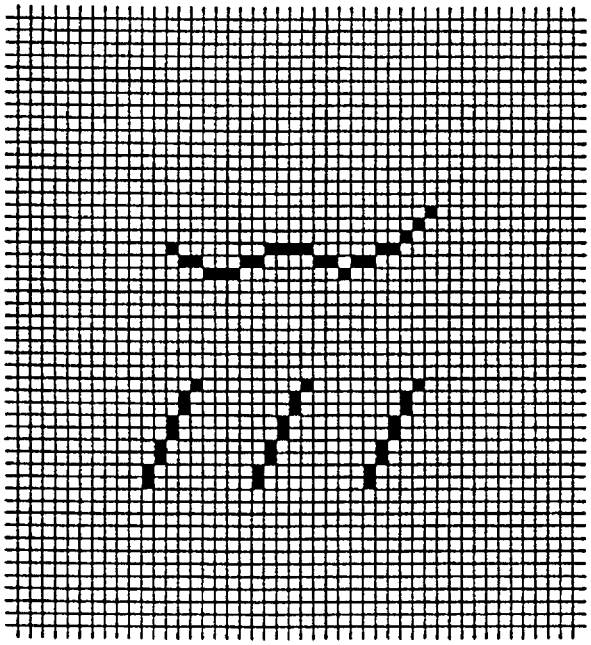
FIG. 7 illustrates the result of a linearizing process.

In step S3, a linearizing process is performed on each set of border line data to extract a pixel chain forming a shape defining line by one of several well-known methods. The shape defining line is the middle line of each concatenated component pattern. The linearizing process deletes the pixels forming the concatenated component pattern sequentially, from the outer pixels according to a predetermined rule, so that a one-pixel-wide line of pixels is formed. FIG. 7 shows the sets of shape defining line data, namely, the pixel chains, obtained from the sets of border line data corresponding to the partial patterns A1–A4, as shown in FIG. 6. The sets of shape defining line data were obtained by executing the linearizing process to an ultimate degree, in which an 8-pixel concatenation was used as a criterion for deciding the concatenation of pixels.

Figure 8:
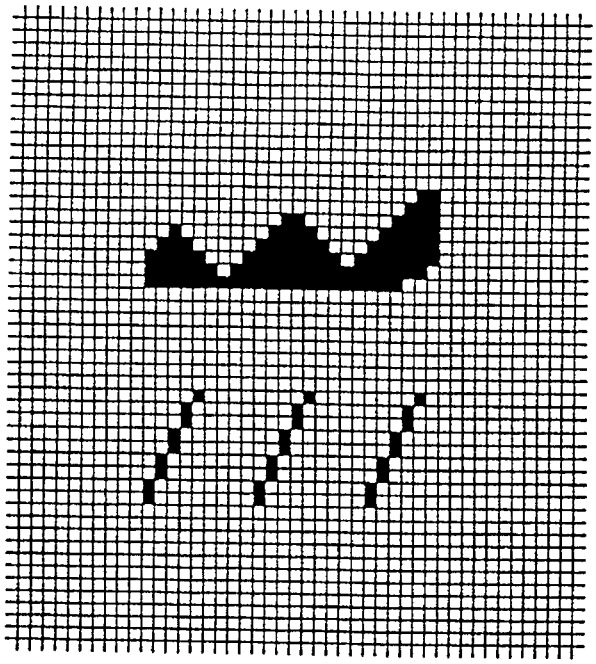
FIG. 8 illustrates the result of executing a given number of sequential pixel deleting cycles of the linearizing process.

The linearizing process is not executed unconditionally to an ultimate degree for all the concatenated component patterns. Rather, a limit is set for the number of sequential pixel deleting cycles. For example, if the concatenated component pattern cannot completely be linearized by three sequential pixel deleting cycles, the linearizing process is interrupted. FIG. 8 shows the shape defining line data obtained by the linearizing process in which the maximum number of sequential pixel deleting cycles was limited to a given number. As is shown in FIG. 8, the partial patterns A2 to A4 representing rainfall are completely linearized, while the partial pattern A1 representing the rain cloud is not completely linearized within the given number of pixel deleting cycles.

In step S4, a query is made to see whether or not each concatenated component pattern has been completely linearized within the given number of sequential pixel deleting cycles. If, in step S4, a particular concatenated component pattern has not completely been linearized within the given number of sequential pixel deleting cycles, control continues to step S5. In step S5, the border line data is selected as the shape representing data representing that particular concatenated component pattern. However, if, in step S4 the concatenated component pattern has been completely linearized within the given number of sequential pixel deleting cycles, control jumps to step S6.

In step S6, the shape defining line data is selected as the shape representing data representing that particular concatenated component pattern. The border line data is selected as the shape representing data when the pattern is spatial and has some area, while the shape defining line data is selected when the pattern resembles a line drawing. Thus, by appropriately setting the given number sequential pixel deleting cycles, a pattern having a spatial shape and some area can be readily distinguished from a pattern resembling a line drawing. Thus, the appropriate shape representing data suitable for representing each concatenated component pattern is determined through steps S4 to S6.

Figure 9:
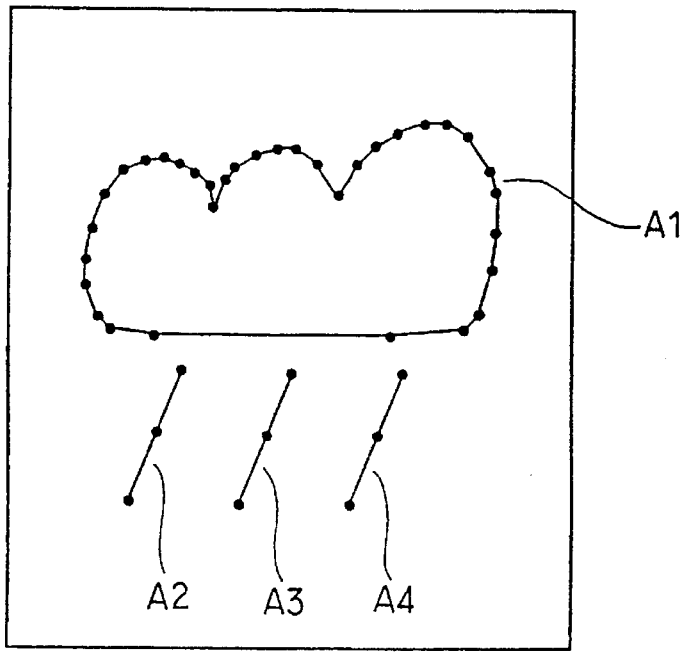
FIG. 9 illustrates extracted feature points.

In the preferred embodiment, the border line data is described by vector data obtained by extracting feature points on the border line and sequentially arranging the feature points. The shape defining line data is described by short-vector data, i.e., a sequence of points extracted at appropriate intervals from points forming the shape defining line. As shown in FIG. 9, the partial pattern A1 of the pattern A is represented by the border line data and the partial patterns A2 to A4 of the pattern A are represented by the shape defining line data.

After the shape representing data has thus been determined, the stitch data is produced in step S7 based on the determined shape representing data. The stitch data for forming satin stitches for entirely covering the space enclosed by a polygon formed by sequentially connecting the feature points (the partial pattern A1) is produced from the border line data. The stitch data for forming zigzag stitches along the shape defining line (the partial patterns A2 to A4) is produced from the shape defining line data. The stitch data is produced by any known method, the description of which is omitted. When the bitmap image represents a plurality of concatenated component patterns, steps S2 to S8 are executed for each of the plurality of concatenated component patterns.

Figure 10:
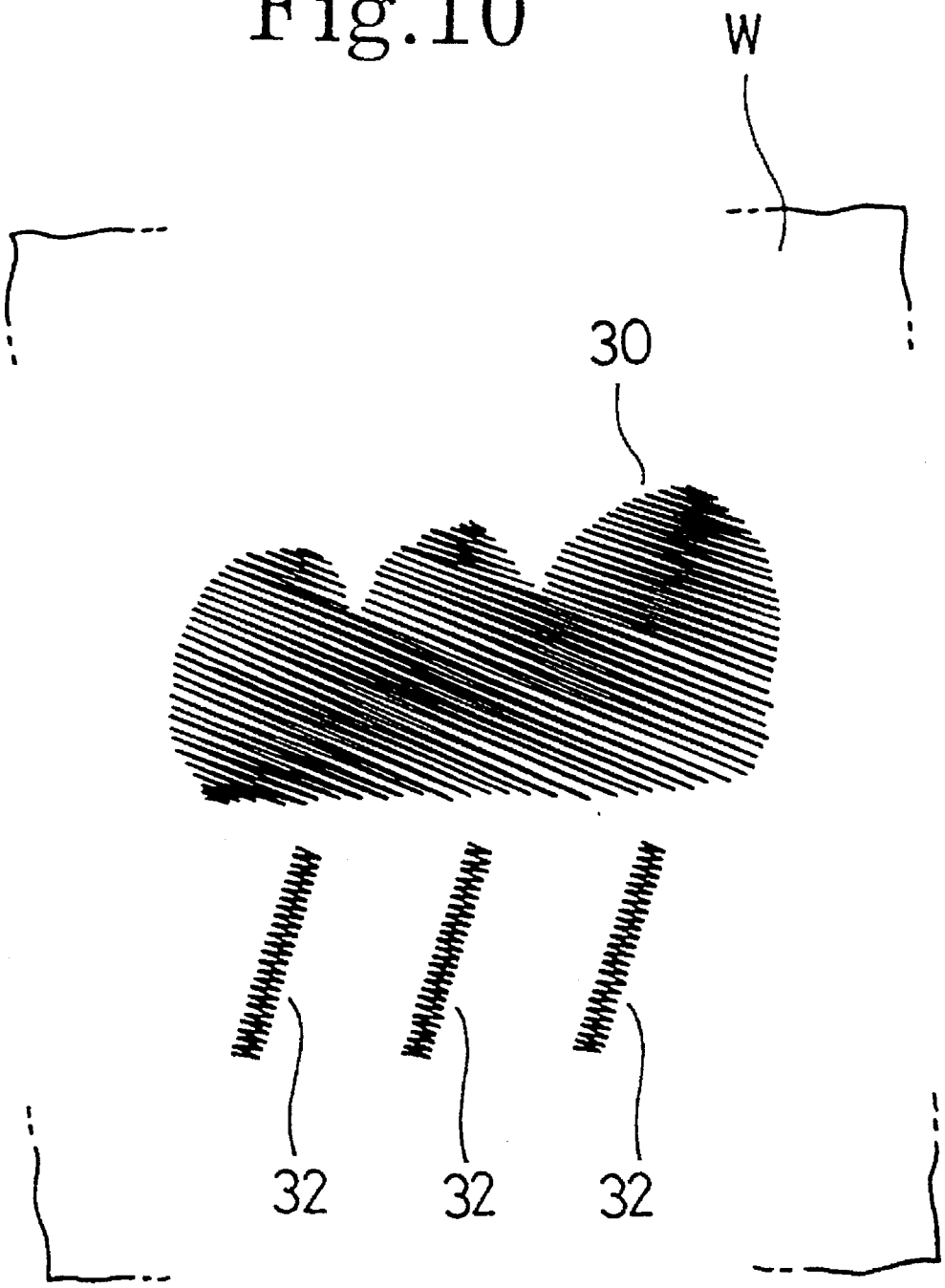
FIG. 10 illustrates stitches formed on a workpiece.

The stitch data thus produced is stored in the flash memory 10. When embroidering the workpiece W, the flash memory 10 is loaded into the data read device 24 of the embroidery sewing machine. Then, the embroidery sewing machine is controlled based on the stitch data to embroider the workpiece W with the pattern A, as shown in FIG. 10. The partial pattern A1 is formed by satin stitches 30, which entirely cover the space enclosed by the border line. The partial patterns A2 to A4 are formed by zigzag stitches 32 formed along the shape defining lines.

While the conventional image processing apparatus requires a manual data input operation to obtain the shape representing data representing the shape of a pattern, the image processing apparatus in this first preferred embodiment automatically extracts the shape representing data representing the shape of the pattern from the bitmap image acquired by scanning the original picture of the pattern. Even if the pattern has miscellaneous partial patterns, such as pictures, characters and such, the image processing apparatus of this first preferred embodiment properly selects between the border line data and the shape defining line data according to the shapes of the miscellaneous partial patterns. Therefore, the appropriate stitch data is produced for the partial patterns according to the shapes of the partial patterns. Consequently, all the partial patterns are embroidered with a satisfactory level of quality.

Furthermore, the image processing apparatus of this first preferred embodiment distinguishes between a pattern having a spatial shape and an area, and a pattern resembling a line drawing, by a simple procedure based on the number of sequential pixel deleting cycles executed during linearization.

The three lines representing rain fall can be formed having the same width, even if the width of the lines is partly widened or one of the three lines is drawn with a width which is different than that of the others when drawing the original picture, because the bit map image data of the lines are linearized to obtain the shape defining lines representing the shapes of the three lines and zigzag stitches are formed in the same width along the shape defining lines.

Figure 11:
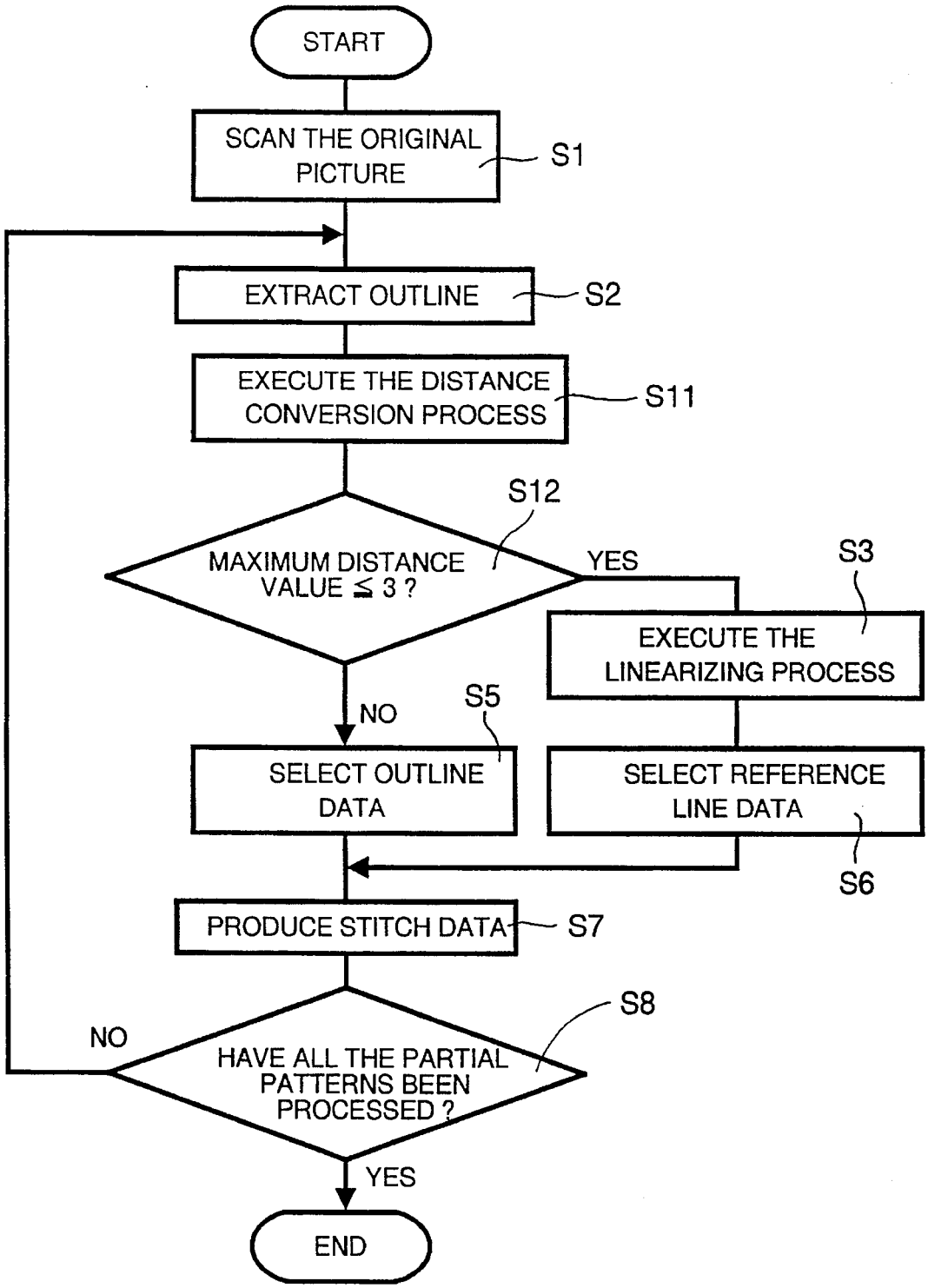
FIG. 11 is a flow chart of a stitch data producing procedure carried out by a second preferred embodiment of the stitch data producing apparatus in according to the present invention.

A second preferred embodiment of the image data processing apparatus according to this invention is shown in FIGS. 11 and 12. The second preferred embodiment differs from the first preferred embodiment in that the second preferred embodiment determines the shape of a concatenated component pattern based on a distance value obtained by the distance conversion of the concatenated component pattern, instead of the shape being based on the number of sequential pixel deleting cycles executed for linearization. Thus, only the parts and functions of the second embodiment which differ from those of the first embodiment are described.

FIG. 11 is a flow chart of a second preferred embodiment of the stitch data producing procedure. The same steps as those of the first preferred embodiment of the stitch data producing procedure are designated by the same step numbers. First, in step S1, a bitmap image is obtained. Then, in step S2, the border line of each concatenated component pattern is extracted.

Then, in step S11, each concatenated component pattern is subjected to a distance conversion process. The distance conversion process employs, for example, a well-known raster scan sequential distance conversion method (4-pixel or 8-pixel). The distance between the periphery of each concatenated component pattern and each pixel allocated to the same partial pattern is, in a sense, an index indicating the depth of the pixel from the periphery. Thus, the shape of the concatenated component pattern, namely, the area, the width and the length, can be estimated from the distance values. FIG. 12 shows the distance values for a portion of the pixels of the pattern A determined by the distance conversion process.

Then, in step S12, a query is made to see whether or not the maximum distance value of each concatenated component pattern is at most a given value. For example, as shown in FIG. 11, the given value is three. If the maximum distance value for any pixel is greater than the given value, i.e., if the response in step S12 is negative, control jumps to step S5. In step S5, the border line data is selected as the shape representing data representing the shape of the concatenated component pattern (partial pattern). If the maximum distance value is not greater than the given value, i.e., if the response in step S12 is affirmative, the shape defining line data will be used as the shape representing data representing the concatenated component pattern (partial pattern), and control jumps to step S3. In step S3, the linearizing process is executed. Then, in step S6, the shape defining line data is extracted.

A distinction between a pattern having a spatial shape and an area and a pattern resembling a line drawing is made based on the maximum distance value. Hence, the appropriate shape representing data suitable for the shape of the concatenated component pattern can be selected. In the pattern partly in FIG. 12, the maximum distance value in the partial pattern A1 is eight and the maximum distance values in the partial patterns A2 to A4 are one. Accordingly, when the given value is three, the border line data is selected for the partial pattern A1 and the shape defining line data are selected for the partial patterns A2 to A4. In step S7, the stitch data is produced for each partial pattern on the basis of the selected shape representing data. Thus, by varying the given number of sequential pixel deleting cycles, the process can be biased towards either selecting the border line data or the shape defining line data. In addition, by selecting an appropriate given number of sequential pixel deleting cycles, the process can be adjusted to the resolution of the scanner or the embroidery sewing machine.

The second preferred embodiment, similarly to the first embodiment, automatically extracts the shape representing data properly representing the shape of each partial pattern from the bitmap image. Consequently, the stitch data suitable for stitching the partial pattern can be produced. The shape of each partial pattern is thus estimated by the simple distance conversion process.

Although the second preferred embodiment estimates the shape of the partial pattern based on the maximum distance value determined by the distance conversion process, it is also possible to estimate the shape of the partial pattern based on the ratio of the number of pixels having distance values at least equal to a given distance value, and the number of all the pixels forming the partial pattern or the mean distance value.

This invention is not limited in its practical application to the preferred embodiments specifically described above. For example, the shape of the partial pattern may be estimated based on the size of the partial pattern along one direction, such as the width or the thickness, instead of the number of sequential pixel deleting cycles or the distance values determined by distance conversion. In addition, the stitches need not be limited to satin stitches and zigzag stitches. Rather, any type of stitch, such as fill stitches and running stitches, may be used. The stitch data producing apparatus may comprise a general-purpose computer system. Alternately, the stitch data producing apparatus may employ a general-purpose graphic data processing computer system, a hard-wired electronic system, an ASIC, or a special purpose computer system.

Although this invention has been described in its preferred form with a certain degree of particularity, obviously many changes and variations are possible therein. It is therefore to be understood that this invention may be practiced other than as specifically described above without departing from the scope and spirit of this invention.

What is claimed is:

1. A stitch data producing apparatus comprising:

input means for inputting bitmap image data of an original picture of a pattern;

determining means for determining an embroidery area having a shape from the bitmap image data;

outline extracting means for obtaining outline data representing an outline of an embroidery area;

reference line extracting means for obtaining reference line data representing a linearized shape of the embroidery area; and determining means for determining which one of the outline data and the reference line data appropriately represents the shape of the embroidery area.

2. The stitch data producing apparatus of claim 1, further comprising counting means for counting a number of sequential pixel detecting cycles of a linearizing process executed to linearize an embroidery area;

wherein said determining means determines which of the outline data and the reference line data is appropriate based on the number of sequential pixel deleting cycles executed during the linearizing process.

3. The stitch data producing apparatus of claim 1, further comprising distance determining means for determining a maximum distance value between pixels of the embroidery area and the outline of the embroidery area;

wherein said determining means determines which of the outline data and the reference line data is appropriate based on the maximum distance value.

4. The stitch data producing apparatus of claim 1, further comprising:

image reading means for reading the original picture of the pattern to obtain the bitmap image data; and stitch data producing means for producing stitch data based on the determined embroidery area and the determined one of said outline data and said reference line data determined by said determining means.

5. The stitch data producing apparatus of claim 4, wherein said stitch data producing means produces stitch data for forming stitches covering a whole space enclosed by the outline of the embroidery area when said determining means determines the outline data is appropriate, and produces stitch data for forming stitches along a reference line when said determining means determines the reference line data is appropriate.

6. A stitch data producing apparatus comprising:

an input circuit inputting a bitmap image data of an original picture of a pattern;

an embroidery extracting circuit extracting and outputting an embroidery area having a shape from the bitmap image data;

an outline extracting circuit extracting and outputting outline data representing an outline of the embroidery area;

a reference line extracting circuit extracting and outputting reference line data representing a linearized shape of the embroidery area; and a control circuit inputting the outline data and the reference line data and determining which one appropriately represents the shape of the embroidery area.

7. The stitch data producing apparatus of claim 6, further comprising a counting circuit counting a number of executed sequential pixel detecting cycles of the linearizing process during linearization of the embroidery area;

wherein said control circuit determines which of the outline data and the reference line data is appropriate based on the number of sequential pixel deleting cycles executed during the linearizing process.

8. The stitch data producing apparatus of claim 6, further comprising a distance determining circuit determining a maximum distance value between pixels of the embroidery area and the outline of the embroidery area;

wherein said determining circuit determines which of the outline data and the reference line data is appropriate based on the maximum distance value.

9. The stitch data producing apparatus of claim 6, further comprising:

a scanner scanning the original picture of the pattern and outputting the bitmap image data to the input circuit, and a stitch data producing circuit producing stitch data based on the determined embroidery area and the determined one of said outline data and said reference line data determined by said control circuit.

10. The stitch data producing apparatus according to claim 9, wherein said stitch data producing circuit produces stitch data for forming stitches covering a whole space enclosed by the outline of the embroidery area when said control circuit determines the border line data is appropriate, and produces stitch data for forming stitches along a reference line when said control circuit determines the reference line data is appropriate.

11. A method for producing stitch data, comprising:

inputting bitmap image data of an original picture of a pattern;

determining an embroidery area having a shape from the bitmap image data;

extracting outline data representing an outline of the embroidery area;

extracting reference line data representing a linearized shape of the embroidery area; and determining which one of the outline data and the reference line appropriately represents the shape of the embroidery area.

12. The stitch data producing method of claim 11, further comprising:

linearizing the embroidery area by executing a number of sequential pixel deleting cycles;

counting the number of sequential pixel deleting cycles executed to linearize the bitmap image data of the embroidery data; and determining which of the outline data and the reference line data is appropriate based on the number of sequential pixel deleting cycles.

13. The stitch data producing method of claim 11, further comprising:

determining a maximum distance value between each of the pixels of an embroidery area and the outline of the embroidery area; and determining which of the outline data and the reference line data is appropriate based on the maximum distance value.

14. The stitch data producing method of claim 11, further comprising:

scanning the original picture of the pattern to obtain the bitmap image data; and producing stitch data based on the determined embroidery area and the determined one of said outline data and said reference line data.

15. The stitch data producing method of claim 14, wherein said stitch data producing step produces stitch data for forming stitches covering a whole space enclosed by the outline of the embroidery area when said determining step determines the border line data is appropriate, and produces stitch data for forming stitches along a reference line when said determining step determines the reference line data is appropriate.

* * * * *